US007448987B2

(12) United States Patent
Arginsky et al.

(10) Patent No.: US 7,448,987 B2
(45) **Date of Patent: *Nov. 11, 2008**

(54) LIGHT UP BOUNCING AND ENTERTAINMENT APPARATUSES

(75) Inventors: Irwin Arginsky, Ellenville, NY (US); Douglas Samore, Kerhonkson, NY (US); Myrna Jargowsky, Ellenville, NY (US)

(73) Assignee: J.M. Originals, Inc., Ellenville, NY (US)

( * ) Notice: Subject to any disclaimer, the term of this patent is extended or adjusted under 35 U.S.C. 154(b) by 50 days.

This patent is subject to a terminal disclaimer.

(21) Appl. No.: 11/384,745

(22) Filed: Mar. 20, 2006

(65) Prior Publication Data

US 2007/0042875 A1 Feb. 22, 2007

Related U.S. Application Data

(63) Continuation-in-part of application No. 11/207,523, filed on Aug. 19, 2005, now Pat. No. 7,381,165.

(51) Int. Cl.
*A63B 25/08* (2006.01)
*A63B 21/008* (2006.01)

(52) U.S. Cl. ..... 482/77; 482/112

(58) Field of Classification Search ..... 482/77–78, 482/111–113; D21/413
See application file for complete search history.

(56) References Cited

U.S. PATENT DOCUMENTS 2,712,443 A 7/1955 Hohberger
2,793,036 A 5/1957 Hansburg
2,871,016 A * 1/1959 Rapaport ..... 482/77
3,074,715 A 1/1963 Taylor
3,116,061 A 12/1963 Gaberson
3,855,979 A 12/1974 Ottaway
4,390,178 A 6/1983 Rudell et al.
4,526,036 A 7/1985 Morrison
4,848,009 A 7/1989 Rodgers
5,490,825 A 2/1996 Wilkinson
5,586,957 A 12/1996 Wilkinson
5,599,088 A 2/1997 Chien
5,628,713 A 5/1997 Wilkinson
5,788,608 A 8/1998 Wilkinson
5,857,939 A 1/1999 Kaufman
5,921,899 A 7/1999 Rose
6,168,555 B1 * 1/2001 Fetterleigh et al. ..... 482/77
6,280,045 B1 8/2001 Anteby
6,379,018 B1 4/2002 Rycroft et al.
6,390,956 B1 5/2002 Seelye
6,558,265 B1 * 5/2003 Middleton ..... 472/135

(Continued)

*Primary Examiner*—Fenn C Mathew
(74) *Attorney, Agent, or Firm*—Lerner, David, Littenberg, Krumholz & Mentlik, LLP

(57) ABSTRACT

The present invention relates to a pogo stick structure, more particularly, a pogo stick comprising a housing unit, foot support plate, piston, spring mechanism, and handlebars. The external portion of the housing unit includes a plurality of LED lights that light in accordance with the piston impinging the ground. LED lights displayed on the housing may be of different colors and may be arranged in a multitude of ways. Furthermore, the displayed LED lights may light in different patterns and at different times as a result of an electronic processing unit. A foam layer may cover the housing and protect the lights from accidental damage. The foam layer and lights may also be used with other entertainment devices such as stick horses.

15 Claims, 12 Drawing Sheets

U.S. PATENT DOCUMENTS

| | | | | |
|---|---|---|---|---|
| 6,589,140 | B1 | 7/2003 | Hsu | |
| D479,733 | S * | 9/2003 | Arginsky | D21/413 |
| D487,484 | S * | 3/2004 | Arginsky | D21/413 |
| 6,716,100 | B2 | 4/2004 | Tsunooka et al. | |
| D491,614 | S | 6/2004 | Arginsky | |
| D493,497 | S * | 7/2004 | Arginsky | D21/413 |
| 6,809,276 | B1 | 10/2004 | Guzman | |
| 6,827,683 | B2 * | 12/2004 | Otawara | 600/123 |
| 2003/0045405 | A1 | 3/2003 | Lin | |
| 2005/0075182 | A1 | 4/2005 | Middleton | |

* cited by examiner

LIGHT UP BOUNCING AND ENTERTAINMENT APPARATUSES

CROSS-REFERENCE TO RELATED APPLICATION

This application is a continuation-in-part of U.S. patent application Ser. No. 11/207,523, filed Aug. 19, 2005, entitled Light Up Bouncing Apparatus, the entire disclosure of which is hereby expressly incorporated by reference herein.

BACKGROUND OF THE INVENTION

This invention relates generally to pogo sticks and, more particularly, to pogo sticks having flashing lights which illuminate in response to bouncing on the pogo stick.

A pogo stick can be generally described as a bouncing apparatus. A user of a pogo stick steps on a foot rest extending from a housing unit, holds handles attached to the housing and hops repeatedly. The user bounces up and down as a piston is forced upward on a spring-like mechanism.

Pogo sticks first became popular in the 1920's. Since then, pogo sticks have been used both for leisure and entertainment purposes. For example, the New York hippodrome chorus girls performed entire shows on them, marriage vows were exchanged on them, exercise is enjoyed by many, jumping contests have been held, and world records for consecutive jumps have been set.

While pogo sticks have been used for entertainment purposes, audiences are focused on the user of the pogo stick rather than the pogo stick itself. For example, a show performed on a conventional pogo stick is entertaining for the viewer because of the actions of the pogo stick operator, rather than the actual pogo stick structure itself.

In the past, designs have included lights on the footpads of pogo sticks. This presented problems for both the observer and operator of the pogo stick. For example, lights on the footpad might be blocked by the operator's feet and prevent an observer from viewing and being entertained by the lights.

Additionally, footpad lights present a serious defect since they might become damaged due to their location near the operator's feet. It is common that while using a pogo stick the feet of the operator may occasionally slip off the foot pads and hit the lights located near or on the foot pads. Thus, it is not desirable to place lights on the footpads.

Further, lights placed near or on the location of the footpads can present a danger to the operator. When feet slip off the footpads during use and cause damage to footpad lights, a loose electrical connection or even an open circuit may result. These present dangerous conditions that could lead to electrical shock and other problems for the operator.

It is also known to position lights at the handlebars of a pogo stick to provide visual feedback to the operator. However, lights in this position are dangerous because the user of the pogo stick looks down instead of looking up at the field of view, making it all too easy to land in an awkward or hazardous position. Also, such lights are not intended for viewing by observers, who may have a hard time viewing such lights, as the operator's hands may be in the way.

It is desirable to provide illumination for pogo-type devices in order to address these and other problems. It is also desirable to add new creativity with pogo devices in order to keep prospective and current users interested in the item. Moreover, new features are needed to enhance the growth and enjoyment of pogo sticks and maintain popularity.

SUMMARY OF THE INVENTION

With the desire to advance the popularity of the pogo stick, various patterns of lights may be placed on the housing of a pogo stick. The patterns of lights may illuminate as the user of the pogo stick jumps up and down on the pogo stick. This increases the pleasure and enjoyment while promoting the entertainment uses for both the user/operator of the pogo stick and the observer/audience of the pogo stick.

In accordance with one embodiment of the present invention, a light up pogo stick is provided. The pogo stick comprises a housing unit, a foot support plate, a piston, a handlebar, a plurality of lights and a controlling unit. The housing unit includes a spring mechanism and has first and second ends. The foot support plate attaches to the first end of the housing unit. The piston couples to the spring mechanism and is capable of extension and retraction relative to the first end of the housing unit. The handlebar attaches to the second end of the housing unit. The plurality of lights are disposed on the housing unit between the first and second ends. The controlling unit is operatively connected to the plurality of lights for turning the lights on and off by impingement of the piston on the ground.

In one alternative, the housing unit comprises a shell substantially surrounding the spring mechanism and the plurality of lights are disposed on the shell. In another alternative, the housing unit comprises a pair of housing support members and the plurality of lights are arranged on the pair of housing support members. In another alternative, the pogo stick further comprises a themed representation disposed adjacent to the handlebars and the second end of the housing unit. The themed representation includes at least some of the lights thereon.

In one example, the plurality of lights are arranged in a spiral pattern. In another example, the plurality of lights is arranged at least one row. In yet another example, the lights illuminate as a result of the impingement of the piston on the ground. In an alternative example, the lights illuminate as a result of an absence of the impingement on the ground by the piston.

In an alternative, the controller includes a switching unit and an electronic processing unit electrically coupled to the switching unit. The electronic processing unit is programmable for different lighting combinations or patterns. In this case, the lights may be programmed for an exercise routine or a game.

In a further alternative, the lights comprise light emitting diodes. In this case, the lights may be different colors. Here, the electronic processing unit desirably lights the LEDs in predetermined color schemes.

In accordance with another embodiment of the present invention, a pogo stick structure is provided. The pogo stick structure comprises a housing unit, a foot support plate, a piston, a handlebar, a controller, lights and a foam covering. The housing unit contains a spring mechanism and has first and second ends. The foot support plate attaches to the first end of the housing unit. The piston is coupled to the spring mechanism and is operable to extend and retract relative to the first end of the housing unit. The handlebar attaches to the second end of the housing unit. The controller is disposed within the housing unit and has wires extending from the controller through a hole in the housing unit. The wires run along at least part of an exterior surface of the housing unit. The plurality of lights are electrically coupled to the controller by the wires. The foam covering at least partly encloses the exterior surface of the housing unit. The foam covering also conceals the wires.

In one alternative, the foam covering includes a plurality of holes therein. The plurality of holes align with the plurality of lights so that the lights are at least partly uncovered. In this case, the controller is preferably disposed within the second end of the housing unit. In an example, the lights are disposed on the exterior surface of the housing.

In accordance with yet another embodiment of the present invention, a pogo stick structure is provided. The structure comprises a housing unit, a foot support plate, a spring mechanism, a piston, a handlebar, a plurality of lights, and a covering. The housing unit has first and second ends. The foot support plate is attached to the first end of the housing unit. The spring mechanism is coupled to the housing unit. The piston is coupled to the spring mechanism and is operable to extend and retract relative to the first end of the housing unit. The handlebar is attached to the second end of the housing unit. The plurality of lights are arranged in a predetermined pattern on an exterior surface of the housing unit. The plurality of lights are operable to illuminate as a result of impingement of the piston on the ground. The covering at least party covers the exterior surface of the housing unit and has holes positioned thereon to permit the lights to be seen.

In one alternative, the covering is a foam covering. In this case, the foam covering preferably substantially covers the housing unit from the first end to the second end.

In accordance with another embodiment of the present invention, a pogo stick apparatus is provided. The apparatus comprises a housing unit, a foot support member, a piston, a foam covering and a plurality of lights. The housing unit includes a spring mechanism and has first and second ends. The foot support member is attached to the first end of the housing unit. The piston is coupled to the spring mechanism. The piston is operable to extend and retract relative to the first end of the housing unit. The foam covering at least partly encloses an exterior surface of the housing unit. The plurality of lights is at least partly protected by the foam covering. The plurality of lights is operable to turn on and off during use of the pogo stick apparatus.

In one alternative, the pogo stick apparatus further comprises a handlebar attached to the second end of the housing unit. In this case, the foam covering desirably at least partly covers the handlebar. In another alternative, the lights are motion activated.

In one example, the foam covering comprises a plurality of layers. In this case, a first one of the layers may at least partly enclose the exterior surface of the housing unit, and a second one of the layers may at least partly cover the first layer. Here, wiring preferably electrically connects the plurality of lights to a power supply. The wiring is at least partly disposed between the first and second layers of the foam covering. Optionally, the second layer of the foam covering has a scalloped pattern revealing portions of the first layer of the foam covering. In this case, at least one of the lights is preferably protected by the first layer of foam covering and is revealed by the scalloped pattern.

In another alternative, the pogo stick apparatus further comprises control means coupled to the plurality of lights for managing operation of the plurality of lights. In this case, the apparatus may further comprise a speaker for producing sounds during use of the pogo stick apparatus. Here, the speaker is also coupled to the control means. The speaker may be at least partly protected by the foam covering.

In another embodiment according to the present invention, an entertainment apparatus comprises a housing having an elongated shaft with first and second ends, a foam layer at least partly covering an exterior surface of the housing, and a plurality of lights at least partly protected by the foam layer. The plurality of lights are operable to turn on and off during use of the entertainment apparatus. The entertainment apparatus may be a stick horse having a horse head representation disposed at the first end of the shaft.

In one alternative, the foam layer comprises a plurality of foam layers. In this case, a first one of the foam layers may at least partly enclose the exterior surface of the housing, and a second one of the foam layers may at least partly cover the first layer. The entertainment apparatus may also include wiring electrically connecting the lights to a power supply with the wiring being at least partly disposed between the first and second layers.

In accordance with a further embodiment of the present invention, a pogo apparatus comprises a housing including spring means, a first end, and a second end remote from the first end; means for supporting a user's feet, the support means being coupled to the first end of the housing; a piston coupled to the spring means, the piston being operable to extend and retract relative to the first end of the housing; a covering at least partly covering the housing between the first and second ends thereof; and lighting means disposed along the housing between the first and second ends thereof, the lighting means being at least partly protected by the covering and being operable to turn on and off during use of the pogo stick apparatus.

In one alternative, the covering comprises a plurality of foam layers. Here, a first one of the foam layers desirably covers at least part of the housing and a second one of the foam layers desirably reveals portions of the first foam layer. In another alternative, the pogo apparatus further comprises control means coupled to the lighting means for managing operation of the lighting means.

DETAILED DESCRIPTION

Figure 1:
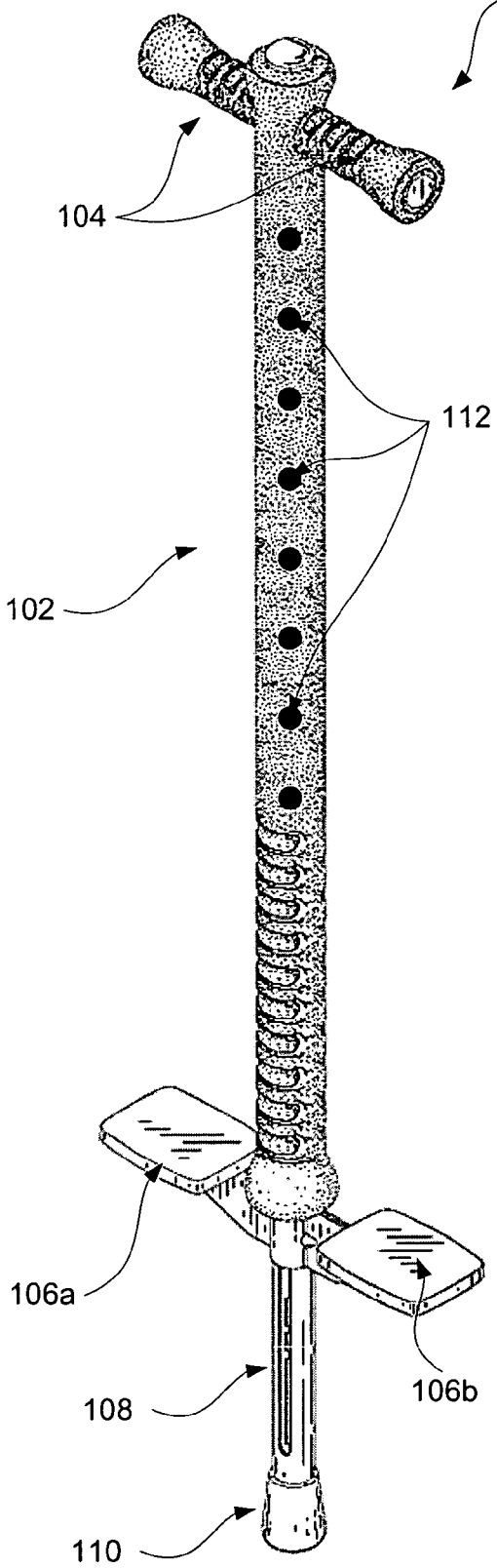
FIG. 1 is a perspective view of a preferred embodiment of the present invention.

Referring to FIGS. 1-5, a preferred embodiment of the present invention is shown as pogo stick 100. The pogo stick 100 includes a housing unit 102. The pogo stick 100 preferably also includes handle bars 104, a foot support plate 106, a piston 108, and a piston endcap 110 attached to the housing 102. A plurality of lights 112 are preferably disposed on the housing unit 102. In this embodiment, the pogo stick 100 is also referred to herein as a single support housing pogo stick.

The housing unit 102 has a top and bottom and can be an elongated cylinder as shown, or alternatively can be an elongated rectangular rod or other configuration. Contained within the housing unit 102 is a spring type mechanism (not shown) capable of allowing the piston 108 to move up and down relative to the housing unit 102 and the foot support plate 106, which is preferably rigidly attached to the housing unit 102. The piston 108 and the spring type mechanism may be conventional configurations found in existing pogo sticks, such as the Maverick™ brand pogo stick made by SBI Enterprises, Inc of Ellenville, N.Y. Details of pogo sticks having enclosed coil springs are shown, for example, by U.S. Pat. No. 2,712,443 to Hohberger, U.S. Pat. No. 2,871,016 to Rapaport, and U.S. Pat. No. 3,116,061 to Gaberson, the disclosures of which are hereby expressly incorporated by reference herein. Of course, it should be understood that other spring mechanisms may be employed, such as pneumatic springs, elastomeric springs, etc.

During use an operator/user of the pogo stick 100 typically rests his or her feet on footpads 106*a, b* of the foot support plate 106 and grasps the handle bars 104. The operator/user then operates the pogo stick to hop or jump along the ground. Every time the piston 108 impinges on the ground, the spring type mechanism becomes constrained to provide energy for the next hop. Constraint of the spring type mechanism becomes relieved when the piston 108 leaves the ground in the next hop. The repeated extensions and retractions of the piston 108 enable the user to traverse the pogo stick 100 along the ground.

In accordance with one example of the present invention, within the foot support plate 106, a controller and power source are preferably contained that operate the plurality of lights 112 on the housing unit 102. The controller operates as a switching mechanism to control the lights, which are preferably light emitting diodes ("LEDs"). The power source may be, e.g., one or more replaceable or rechargeable batteries. By way of example only, the controller may comprise a flasher or switching modules such as described in U.S. Pat. Nos. 5,599,088 and 6,809,276, the entire disclosures of which are hereby incorporated by reference herein. The controller and/or the power source may be placed in other locations of the pogo stick. For example, in one alternative, the controller and/or the power source may be contained within the upper portion of the housing unit 102, so as not to interfere with the spring type mechanism. In another alternative, the controller and/or power source may be disposed within one or both of the handle bars 104, or within the piston 108. Additionally, the controller and power source do not have to be disposed adjacent or within close range of each other, and instead may be placed in separate locations along the pogo stick 100. While the controller is described in relation to the present embodiment, it may be employed in any of the embodiments described herein.

When the piston 108 impinges the ground, the controller operates the LED lights 112, preferably causing them to illuminate. When force from the piston 108 impinging the ground is relieved, the controller preferably causes the LED lights 112 on the pogo stick to turn off. The controller can also be set up to work in the reverse manner from that described, i.e., no force from the piston 108 impinging the ground causes the LED lights 112 to turn on and a force from the piston 108 impinging the ground causes the LED lights 112 to turn off. Alternatively, the lights 112 may be motion activated to turn on even if there is no impingement with the ground.

Figure 2:
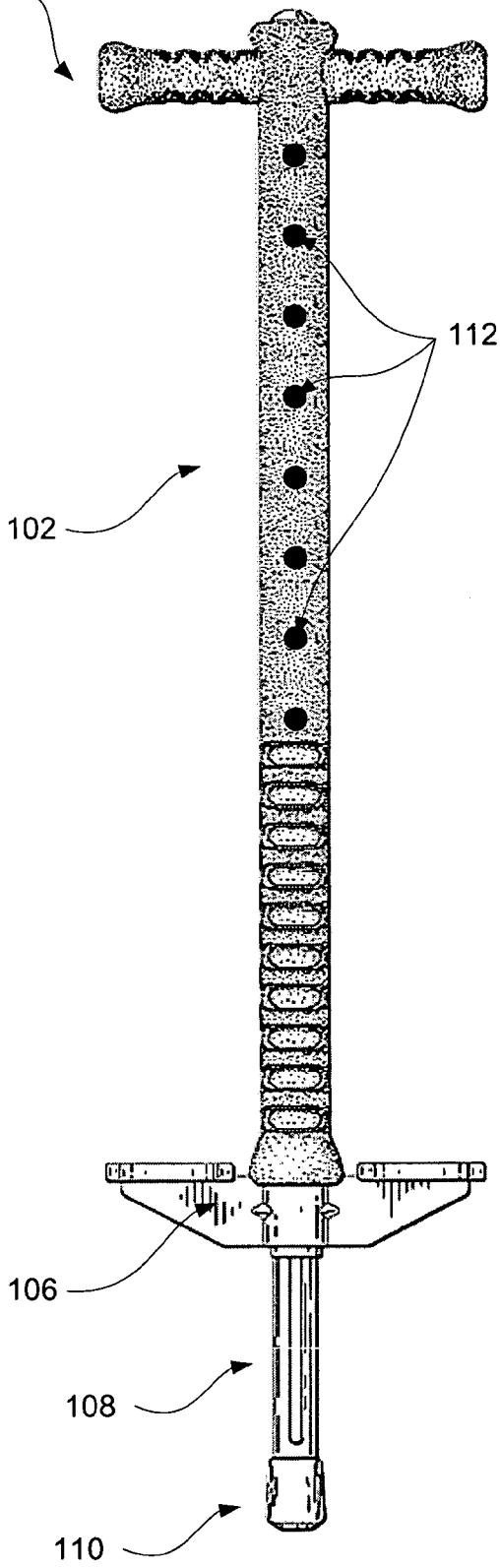
FIG. 2 is a front view of the embodiment of FIG. 1.

The plurality of LED lights 112 can be arranged on the housing unit 102 in a multitude of configurations. For example, one or more rows of LED lights may be placed on the housing unit 102 in a vertical or horizontal arrangement. FIGS. 1-2 illustrate a vertical row of the LED lights 112. The LED lights 112 may alternatively be arranged in a spiral pattern, twisting around the single housing unit 102, for example. The LED lights 112 can be arranged in multiple rows of circles around the circumference of the single housing unit 102 to cover all or a part of the entire length of the housing unit 102. The LED lights 112 can alternatively be arranged in any other pattern or even randomly on the housing unit 102. Thus, it should be understood that the invention is not limited to the specific arrangements of lights described herein. Additionally, if the housing unit 102 has a hollowed out configuration, the LED lights 112 can be placed on any side or sides of the housing unit 102. By way of example only, the lights 112 may be placed along the front or the back of the housing unit 102 so as to provide an unobstructed view to onlookers. Furthermore, placing the lights 112 on the housing unit 102 instead of on the foot support plate 106 and/or the handlebars 104 enables onlookers to view them as the rider bounces up and down on the pogo stick 100, without the rider's feet or hands obstructing the view.

An alternative embodiment of a pogo stick 200 in accordance with the present invention is illustrated in FIGS. 6-10. Here, the pogo stick 200 comprises a housing unit 202, to which are connected a foot support plate 206, a piston 208, a piston endcap 210, and handle bars 204. A plurality of lights 212 are preferably disposed on or within the housing unit 202. The housing unit 202 in this embodiment preferably comprises a shell 214 that encloses a spring type mechanism or mechanisms therein (not shown). The shell 214 may alternatively be made clear so that the inside mechanics, including the spring type mechanism, may be seen. The shell 214 may also have an adjustment mechanism to allow for the ability to change the arrangement and configuration of lights. Preferably, the shell 214 and the spring type mechanism of this embodiment are the same or similar to those disclosed in U.S. Pat. No. 6,558,265, entitled "Scalable High-Performance Bouncing Apparatus," in U.S. Pat. No. 6,716,108, also entitled "Scalable High-Performance Bouncing Apparatus," and in U.S. patent application Publication No. 2005/0075182, published Apr. 7, 2005 and also entitled "Scalable High-Performance Bouncing Apparatus," the entire disclosures of which are hereby incorporated by reference herein. In particular, the spring mechanism in this embodiment desirably comprises one or more elastomeric members or bands. As described in the patent publication at paragraph 0070, "The thrust assembly includes a piston 150, shown in FIG. 1*d*, having the foot 140 at a distal end; at least one bearing (including in this embodiment a single bearing 170, shown in FIG. 1*f*) mounted between the carriage assembly and the piston 150 for easing the retraction and extension of the foot 140 and for limiting lateral movement of the piston 150 relative to the carriage assembly; at least one tension element 180 (in this embodiment, a plurality of tension elements 180) shown in FIG. 1*c* (mounted to the carriage assembly at a lower mount or carriage mount 190 of the lower insert 110, shown in FIG. 1*f*, and to the piston 150 via an upper mount or piston mount 200, shown in FIG. 1*g*, that is part of an upper attachment 204, shown in FIG. 1*g*, that is attached to the piston 150) that supplies the tension force, and an arresting assembly (including an upper face 210 of a carriage assembly feature 220 shown in FIG. 1*f* and a lower face 230 of a piston feature 240 shown in FIG. 1*g*)."

A controller and power source equivalent to that described in the embodiment of FIGS. 1-5 are preferably contained within one or more sections of the pogo stick 200 with sufficient size to accommodate the controller and power source. For example, the controller can be located within the upper portion of the housing unit 202 at or near the handlebars 204. The controller and power source may work in the same manner as previously described herein.

The one or more lights 212, such as LED lights, may be displayed in various positions on the housing unit 202. Desirably, the shell 214 of the housing unit 202 has four sides. The LED lights 212 may be placed on the shell 214 and may appear on one or more sides of the shell 214. Desirably, the LED lights 212 may appear on the front and/or the back of the shell 214, so as to be unobstructed by the rider during normal operation.

The LED lights 212 can be arranged on the shell 214 in a multitude of configurations. For example, as pictured in FIG. 6, a single row of vertical LED lights 212 can be positioned on one or more sides of the shell 214. This can also be done in a horizontal arrangement and be done with more than one row of LED lights. The LED lights 212 can alternatively be arranged in a spiral pattern, twisting around the housing unit 202, for example. LED lights 212 can be arranged in multiple rows of circles around the circumference of the single housing unit 202. The arrangement may cover all or a part of the housing unit 202. Additionally, LED lights 212 can be arranged randomly on the housing unit 202. The LED lights 212 may be of different shapes, sizes and/or colors. The housing unit 202 in this embodiment may alternatively have a cylinder or other geometrical cross-sectional shape, and the lights 212 can be placed on the cylinder or other shape in any of the aforementioned patters consistent with the spirit of the invention. The lights 212 may be disposed on the shell 214, may be at least partly embedded in the shell 214, and/or may be placed within the housing unit 202. In the latter case, the lights 212 may be placed behind a translucent or opaque section of the shell 214 so that light from the lights 212 shines through the shell 214. In addition, embedding or placing the lights 212 within the housing unit 202 serves to provide protection to the lights 212 from damage during use of the pogo stick 200 or if it is inadvertently dropped.

FIGS. 11-15 illustrate yet another embodiment of the present invention. Pogo stick 300 preferably comprises two or more housing support units 302, such as the housing support units 302*a* and 302*b* shown. A pair of handle bars 304, a foot support plate 306, a piston 308, a piston endcap 310, and a spring 311 are preferably connected to the housing support units 302. A plurality of lights 312, such as LEDs, are desirably positioned on the housing support units 302. As pictured, the housing support units 302 are cylindrical but can be made in any other shape, such as an elongated rectangular rod, a hexagonal rod, etc.

In this embodiment of the present invention, a controller and power source, equivalent to those described in the previous embodiments, are preferably contained in a location(s) on the pogo stick 300 that has enough room to accommodate the controller and power source. For example, the controller and power source can be contained within the upper portion of one or both of the housing support units 302 below the handlebars 304.

The plurality of LED lights 312 can be arranged on the housing support units 312 in a multitude of configurations, as discussed above. For example, as pictured in FIG. 11, one vertical row of LED lights 312 can be seen on each of the housing support units 302. LED lights 312 may be placed on the housing support units 302 in a horizontal arrangement as well. The LED lights 312 can alternatively be arranged in a spiral pattern, twisting around the housing support units 302, for example. The LED lights 312 can be arranged in multiple rows of circles around the circumference of the housing support units 302 that cover all or a part of the entire length of the housing support units 302. The LED lights 312 can be arranged in any other pattern or can even be randomly distributed on the housing support units 302, for example. Desirably, the lights 312 are positioned along the housing support units 302 so as to provide a generally unobstructed view to observers.

Optionally, the housing support units 302 may each be, for instance, a hollowed out rod. LED lights 312 can be placed on any side or sides of the housing support units 302. For example, LED lights 312 may appear on one side of the housing support units 302, two sides, three sides, four sides, or every other side. The LED lights 312 appearing on any side may appear in any configuration herein enumerated.

Figure 12:
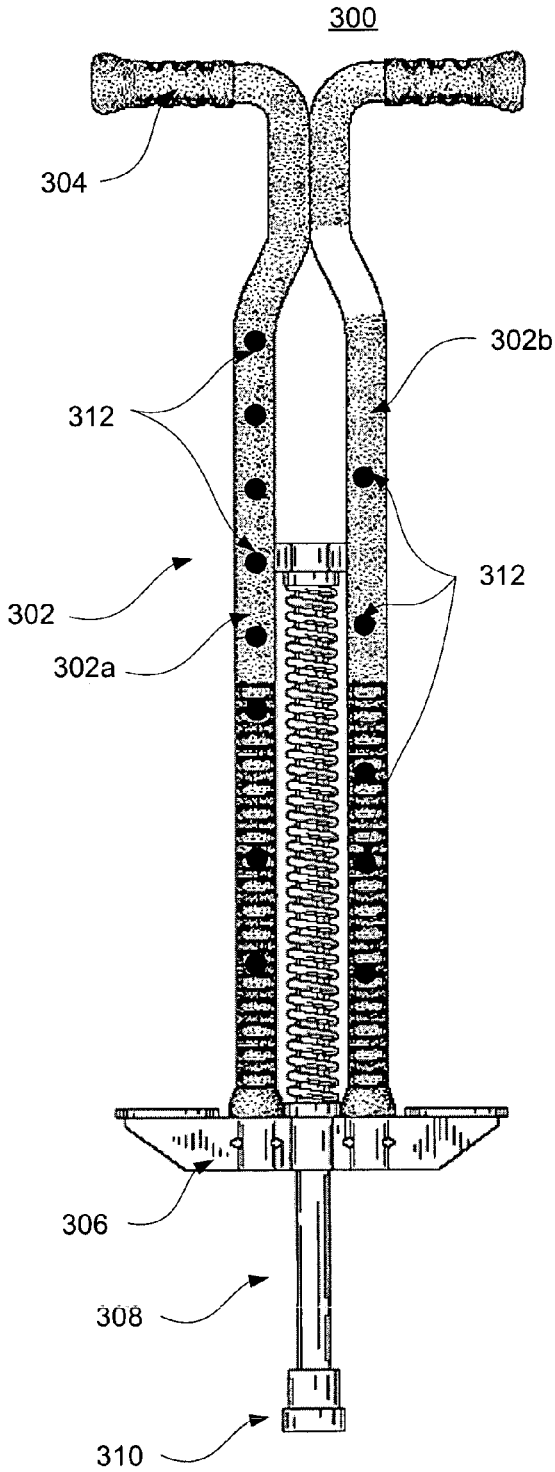
FIG. 12 is a front view of the embodiment of FIG. 11.
Figure 13:
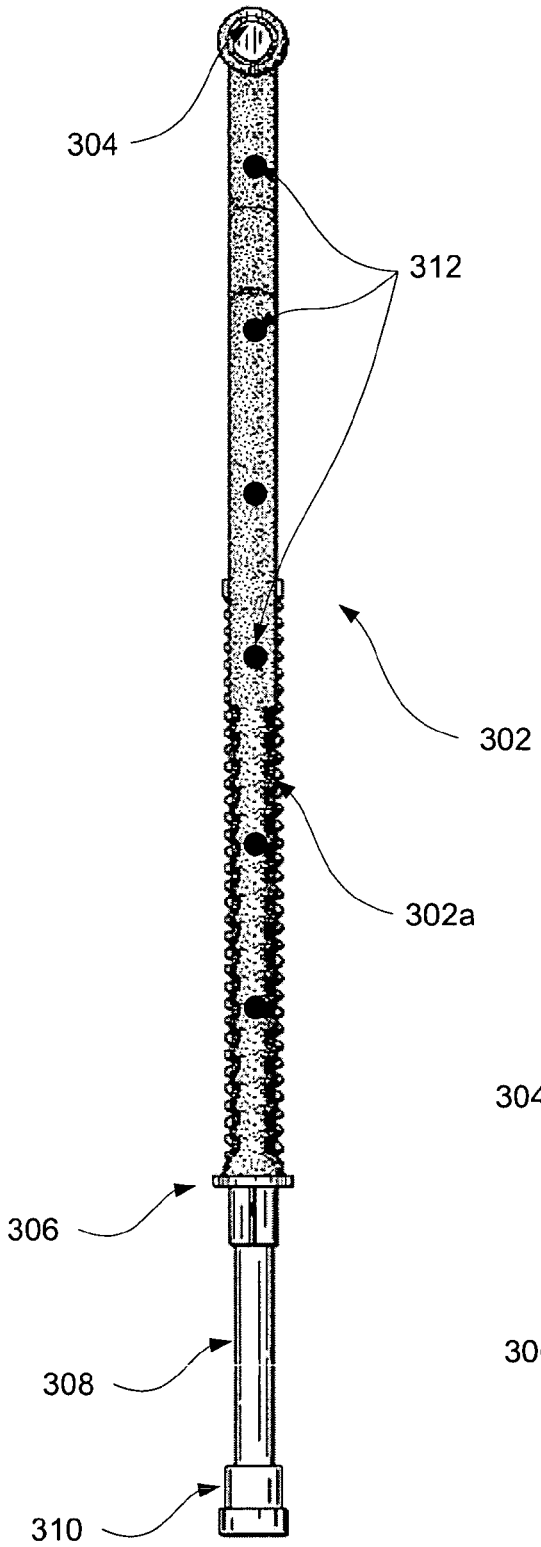
FIG. 13 is a side view of the embodiment of FIG. 11.
Figure 14:
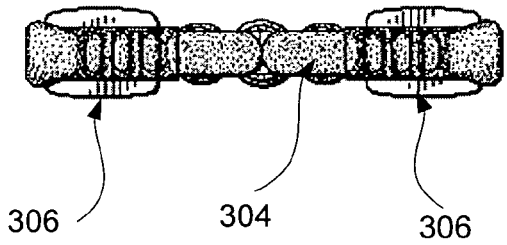
FIG. 14 is a top view of the embodiment of FIG. 11.
Figure 15:
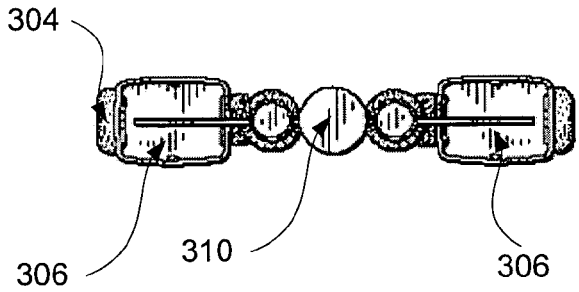
FIG. 15 is a bottom view of the embodiment of FIG. 11.

As shown in FIG. 12, LED lights 312 may also be placed on the upper portion of the piston 308. When the piston 308 moves upward and the spring 311 is in a compressed position, the upper portion of the piston 308 becomes unobstructed by the spring 311. Lights 312 can be placed here for further entertainment and enjoyment. The lights 312 can be controlled so that they illuminate when the spring 311 is in the compressed position, when the piston 308 is at least partly obstructed by the spring 311, or in any other timing arrangement.

Figure 16:
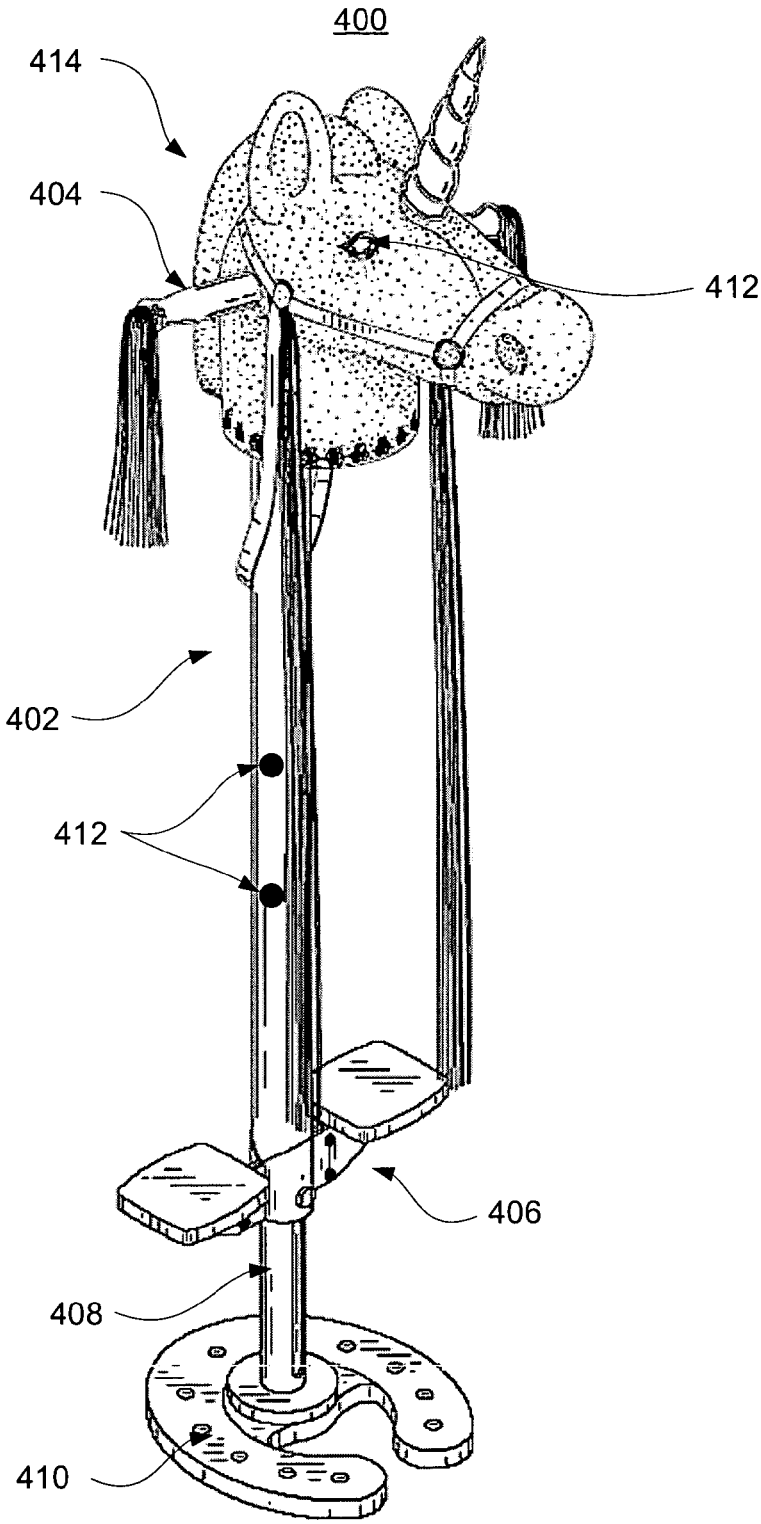
FIG. 16 is a perspective view of another embodiment of the present invention.

FIG. 16 illustrates a further embodiment of the invention, namely a themed or stylized pogo stick 400. The themed pogo stick 400 can be made in accordance with any of the housing and other structures in the aforementioned embodiments. As seen in FIG. 16, the pogo stick 400 may include a stylized unicorn head 414 disposed on or around handlebars 404 and housing 402 or their equivalents. However, the invention is not limited to the stylized unicorn head 414 but also may be used with other themed characters, animals, figures or likenesses, human or otherwise, which are collectively referred to as thematic or themed representations. In addition to lights such as LED lights 412 being placed on the pogo stick in locations disclosed in the other embodiments herein described, the LED lights 412 can be placed within the eyes of the themed pogo stick 412. The themed pogo stick may be, by way of example only, a unicorn, horse, cartoon figure, action figure, etc. Thematic representations on pogo sticks may be found, for example, in U.S. Design Pat. No. D491,614, entitled "Unicorn Pogo," which issued Jun. 15, 2004, and in U.S. Design Pat. No. D493,497, entitled "Pogo Stick", which issued Jul. 27, 2004, the entire disclosures of which are incorporated by reference herein. In addition to the LED lights 412 being placed as eyes on the themed pogo stick 400, other lights 412 may also be placed on other areas of the figurine, for example in the mouth, nose and/or ear regions.

In any of the aforementioned embodiments, different color lights such as LEDs may be used in any of the configurations and arrangements. Colored arrangements may include one or more different colors of lights. Colors may include but are not limited to blue, red, yellow, orange, blue, green, infrared or any other color displayed with an LED or other light.

Referring to FIGS. 17-21, a preferred embodiment of the invention is shown. Pogo stick 500 comprises a housing unit 502, as well as handle bars 504, a foot support plate 506, and a piston 508 and spring-type assembly connected thereto. A piston endcap 510 may be disposed on the end of the piston 508 that contacts the ground. By way of example only, the piston endcap 510 may comprise a molded rubber endcap. The pogo stick 500 preferably also includes a plurality of lights 512 on the housing unit. In this embodiment, the controller 513 is preferably contained at or near the top of the housing unit 502, for example within the housing unit 502 adjacent to the handle bars 504. The top portion of the housing unit 502 is shown in a partial see-through view to illustrate the controller 513 and other elements such as wiring. In operation, a cap 515 to the housing unit 502 may be removed to allow access to the controller 513 for purposes of changing batteries and/or making adjustments. The cap 515 may also be illuminated with one or more LEDs or other lights. Alternatively, the controller 513 may be placed, for example, in the handlebars 504 where end caps 517 on the handlebars 504 may be used to gain access to the controller 513 for purposes of changing batteries and/or making adjustments. Adjustments may include changing the pattern and/or order the lights may turn on and off.

These adjustments may be achieved in several ways. For instance, mechanical contacts such as DIP switches, electrical contacts, etc on the controller 513 may be used to manually program the lighting. Alternatively, the controller 513 may include a connector such as a USB connector, and the lighting pattern(s) may be updated by uploading a new program or instructions to the controller 513. Of course, a wireless link may provide communication between the controller 513 and a remote programming device, such as a desktop or laptop computer, PDA, cell phone, etc.

Figure 17:
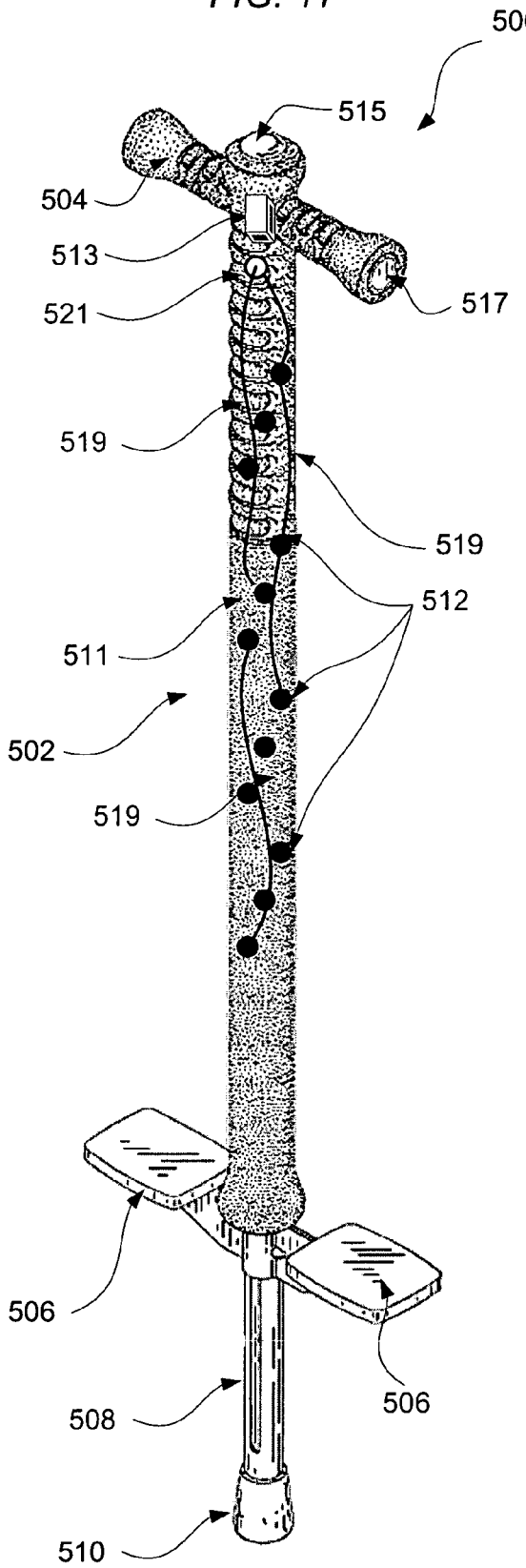
FIG. 17 is a perspective view of another preferred embodiment of the present invention.
Figure 18:
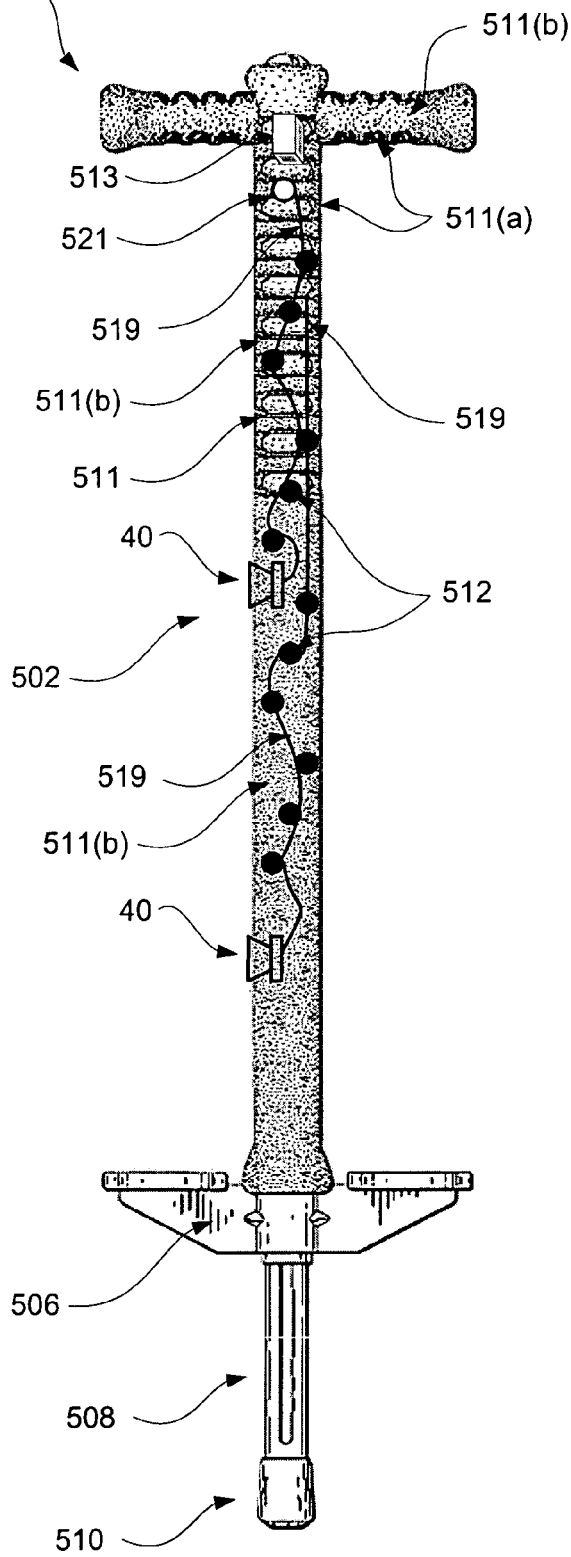
FIG. 18 is a front view of the embodiment of FIG. 17.
Figure 19:
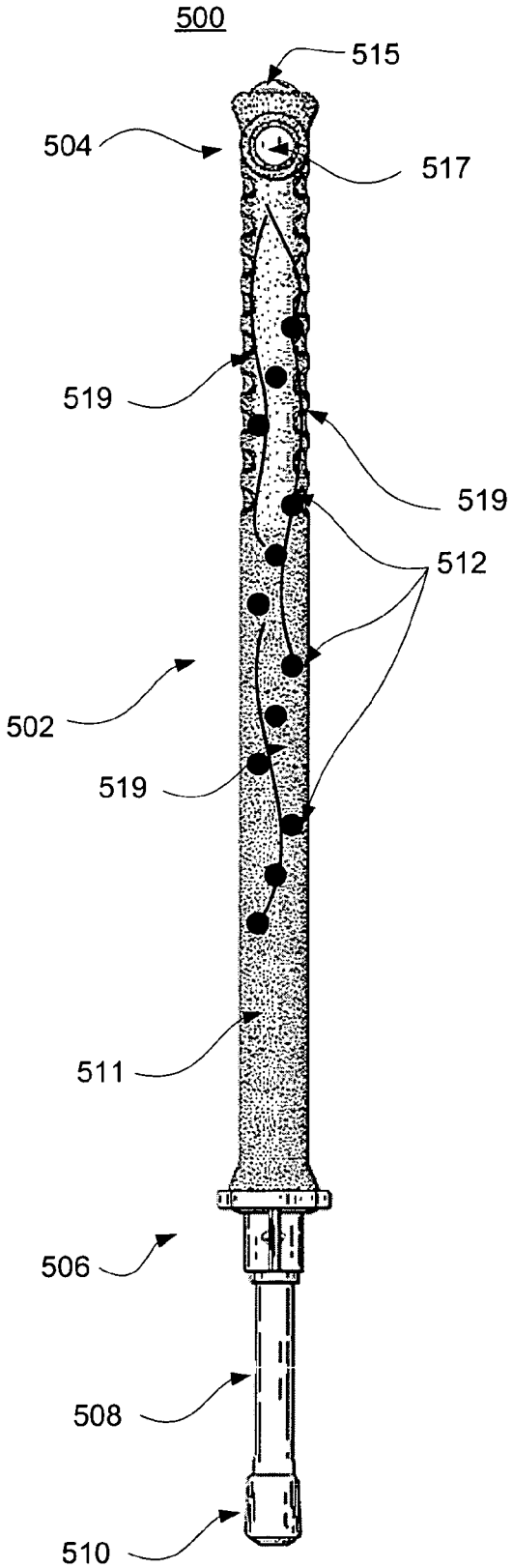
FIG. 19 is a side view of the embodiment of FIG. 17.
Figure 20:
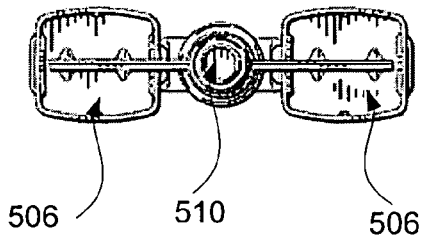
FIG. 20 is a bottom view of the embodiment of FIG. 17.
Figure 21:
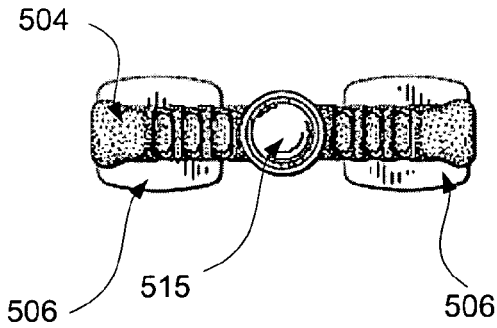
FIG. 21 is a top view of the embodiment of FIG. 17.

The partial see-through views of FIGS. 17-19 show wires 519 from the controller 513 may run through a main hole 521 in the housing unit 502 and then are preferably wrapped around the outer portion of the housing unit 502. Ends of the wires 519 connect to the LED lights 512. Alternatively, the wires 519 may run within an interior section of the housing unit 502 and then branch out to connect with the LED lights 512; however, this case may necessitate multiple holes 521 in the housing unit 502. The wires 519 and/or the LED lights 512 are desirably secured to the housing unit 502 by glue, tape, fasteners, etc. Preferably, a covering 511 such as a foam covering or layer covers at least part of the housing unit 502, including the wires 519. The foam covering 511 may run, for example from the cap 515 down to an area adjacent the foot support plate 506. The foam covering 511 may be attached by glue, tape, etc, and desirably has holes where the LED lights 512 are located. The foam covering 511 can be used to hide the wires 519 and the holes in the foam covering enable the LED lights 512 to be viewed without obstruction. The foam covering 511 may provide a decorative appearance, and also serves to cover the wires 519 and protect the LED lights 512 from damage if the pogo stick 500 falls to the ground.

The foam covering 511 may be a single piece or may comprise multiple sections and/or layers. Each section and/or layer may have different colors, patterns, designs, textures, thickness or configurations. The foam covering 511 may also be applied to portions of the foot support plate 506. In this case, because the foam covering 511 provides protection to the lights 512 as explained above, it would be possible to include lights 512 on the portions of the foot support plate 506 covered by the foam covering 511. Of course, it should be understood that the foam covering 511 could also be applied to other pogo devices such as shown in FIGS. 6-10.

Figure 3:
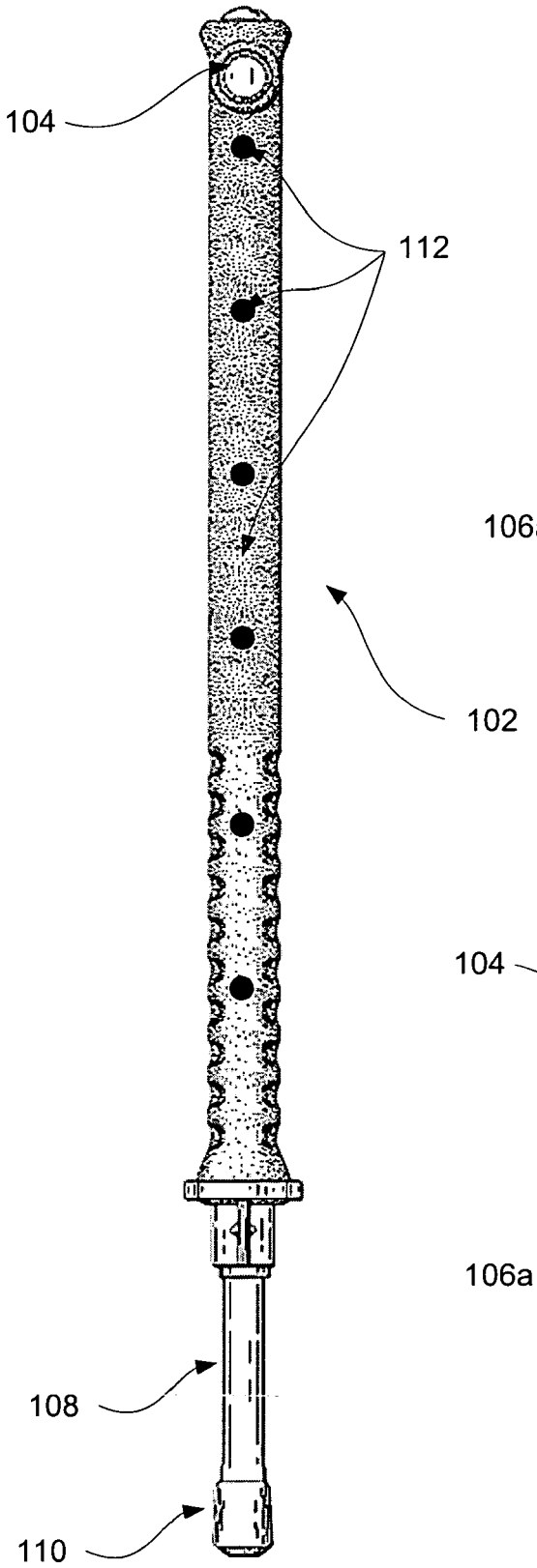
FIG. 3 is a side view of the embodiment of FIG. 1.
Figure 4:
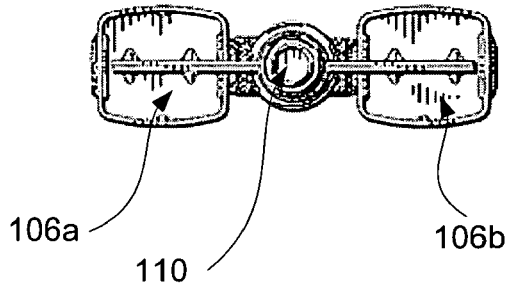
FIG. 4 is a bottom view of the embodiment of FIG. 1.
Figure 5:
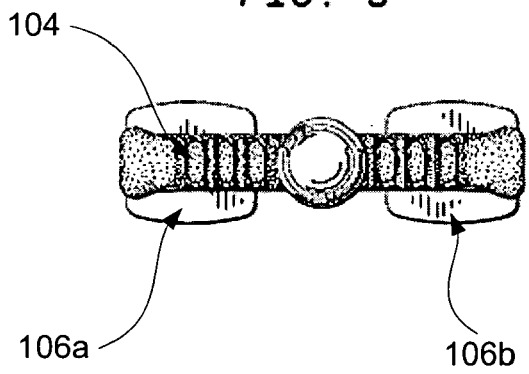
FIG. 5 is a top view of the embodiment of FIG. 1.
Figure 6:
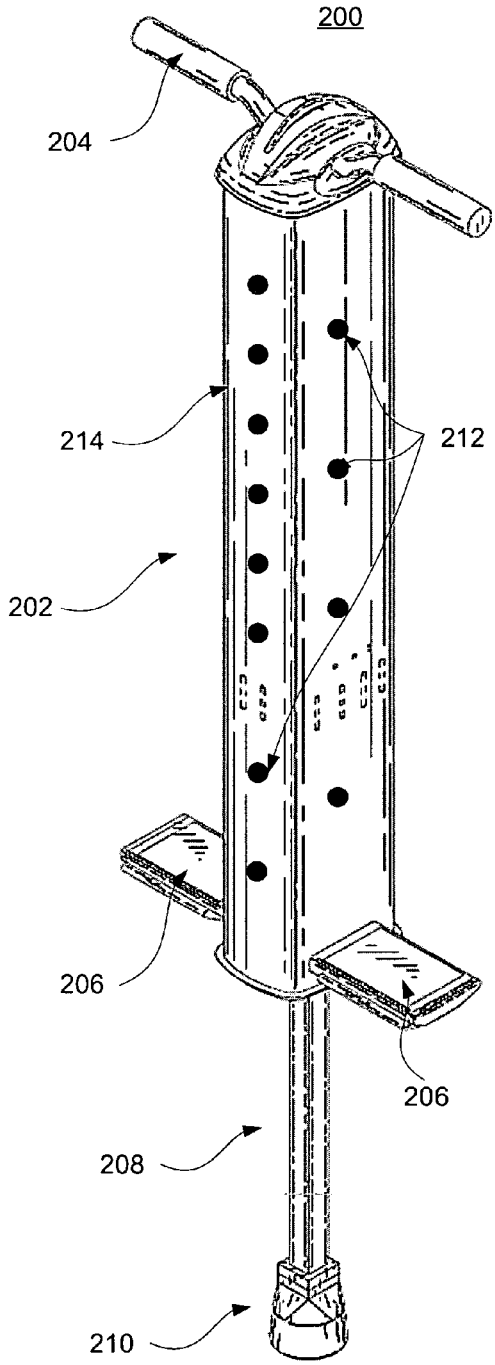
FIG. 6 is a perspective view of another embodiment of the present invention.
Figure 7:
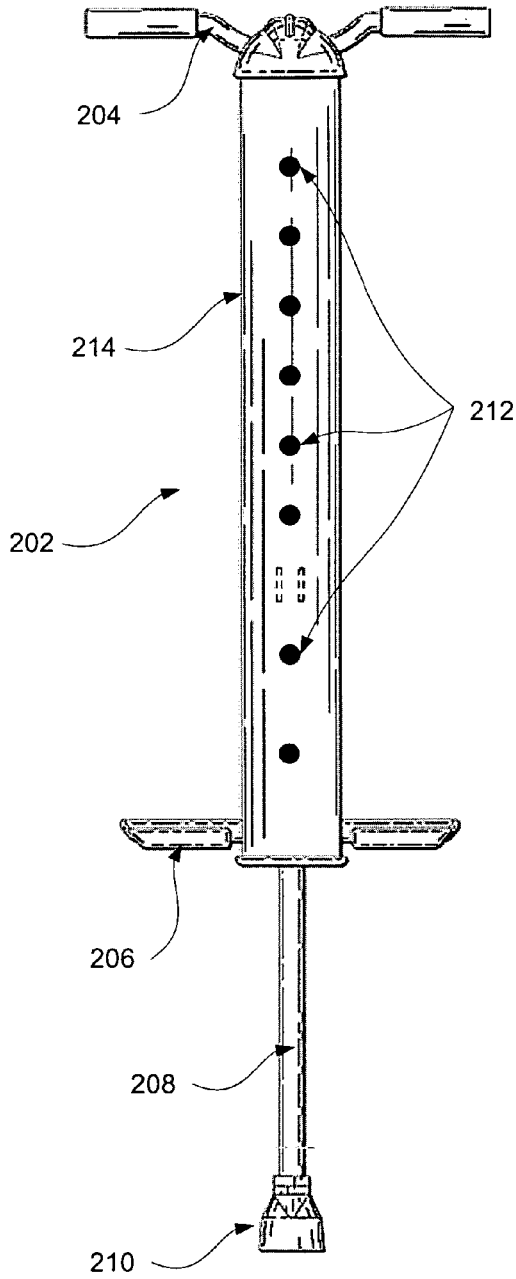
FIG. 7 is a front view of the embodiment of FIG. 6.
Figure 8:
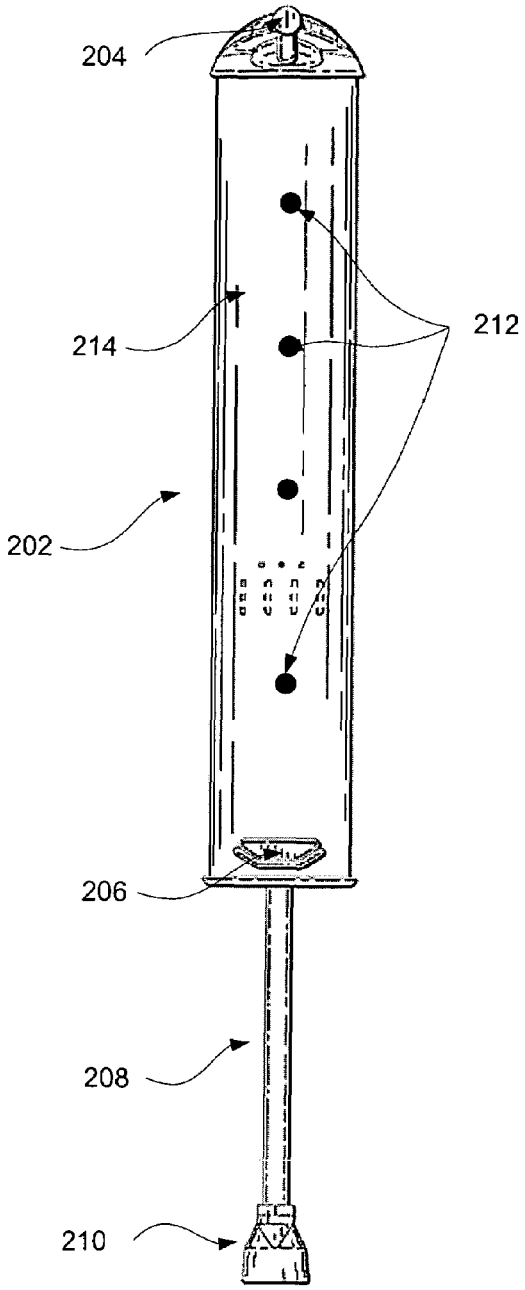
FIG. 8 is a side view of the embodiment of FIG. 6.
Figure 9:
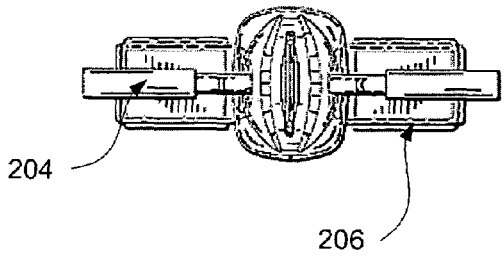
FIG. 9 is a top view of the embodiment of FIG. 6.
Figure 10:
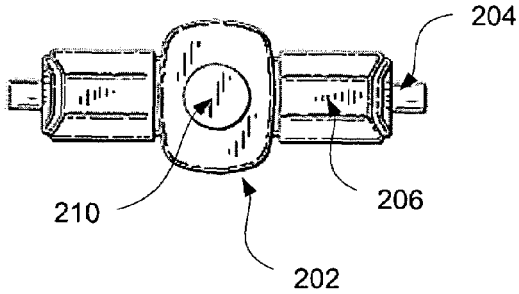
FIG. 10 is a bottom view of the embodiment of FIG. 6.
Figure 11:
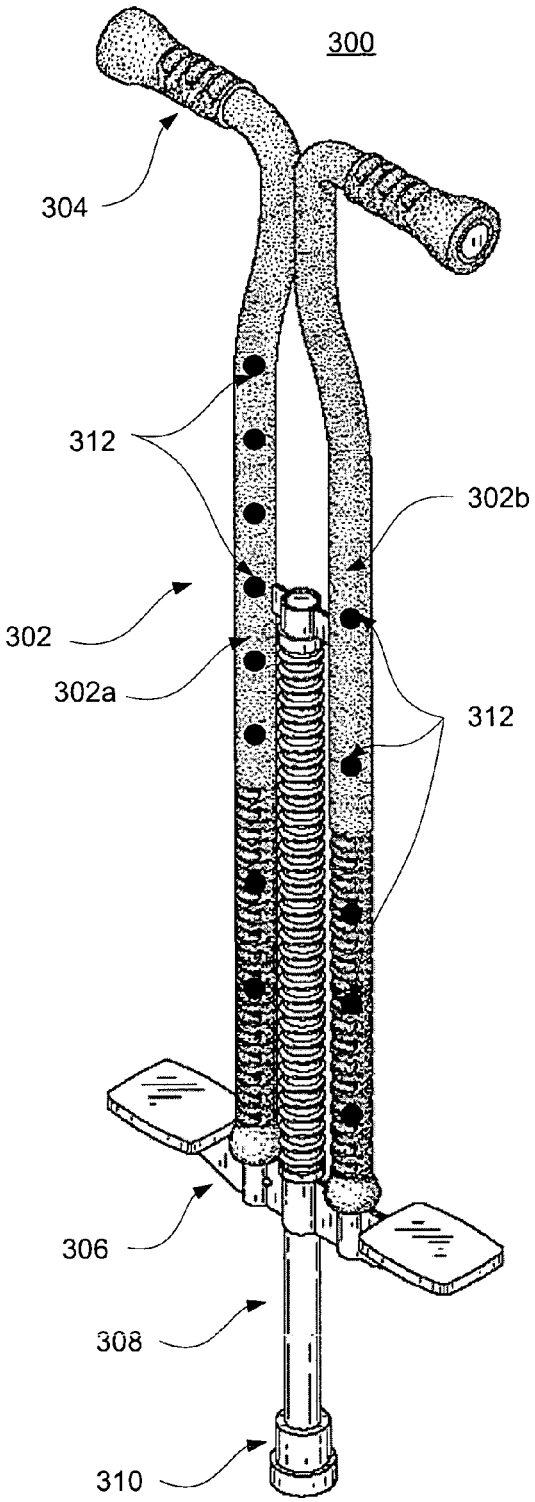
FIG. 11 is s perspective view of a further embodiment of the present invention.

As shown in on the upper portion of the housing unit and handle bars of FIGS. 17-19 and on the lower portion of the housing unit and handle bars of FIGS. 1-3, the foam may, by way of example only, be formed in two layers in a "scalloped" appearance. For instance, as seen in FIG. 18, inner foam layer 511(*a*) may cover the housing unit 502 and the handle bars 504, and outer foam layer 511(*b*) may partially cover the inner foam layer 511(*a*), with openings to reveal portions of the underlying inner foam layer 511(*a*). Preferably, the wiring 519 is sandwiched between the inner and outer foam layers 511(*a*) and 511(*b*).

In manufacturing, the inner foam layer 511(*a*) is preferably first applied to the housing 502 and handle bars 504. For instance, the inner foam layer 511(*a*) may be extruded over the housing 502 and/or the handle bars 504. Then the wires 519 and the lights 512 may be secured to the inner foam layer 511(*a*). Next, the outer foam layer 511(*b*) is preferably applied over the inner foam layer 511(*a*), the wiring 519 and the lights 512 by, for example, extrusion. Then the scalloped areas of the outer foam layer 511(*b*) may be cut away, revealing the inner foam layer 511(*a*). Portions of the outer foam layer 511(*b*) may also be opened up to reveal the lights 512. Alternatively, the outer foam layer 511(*b*) may be precut prior to extrusion over the inner foam layer 511(*a*), the wiring 519 and the lights 512. Creating the scalloping and/or the openings for the lights 512 prior to extrusion reduces the possibility that the wiring 519 can be cut or otherwise damaged.

It is also possible to wrap a foam sleeve embedded with lights 512 and wiring 519 around parts of the pogo stick 500, such as the housing 502, the handle bars 504 and even the foot support plate 506. In this case, the lights 512 and the wiring 519 may be pre-positioned with respect to the foam sleeve. This makes it easy to position the lights 512 on the pogo stick 500 exactly where desired. Optionally, the lights 512 may be releasably connected to the wiring 519 to enable replacement or interchange of the lights 512. A quick snap connection may be used.

Figure 22:
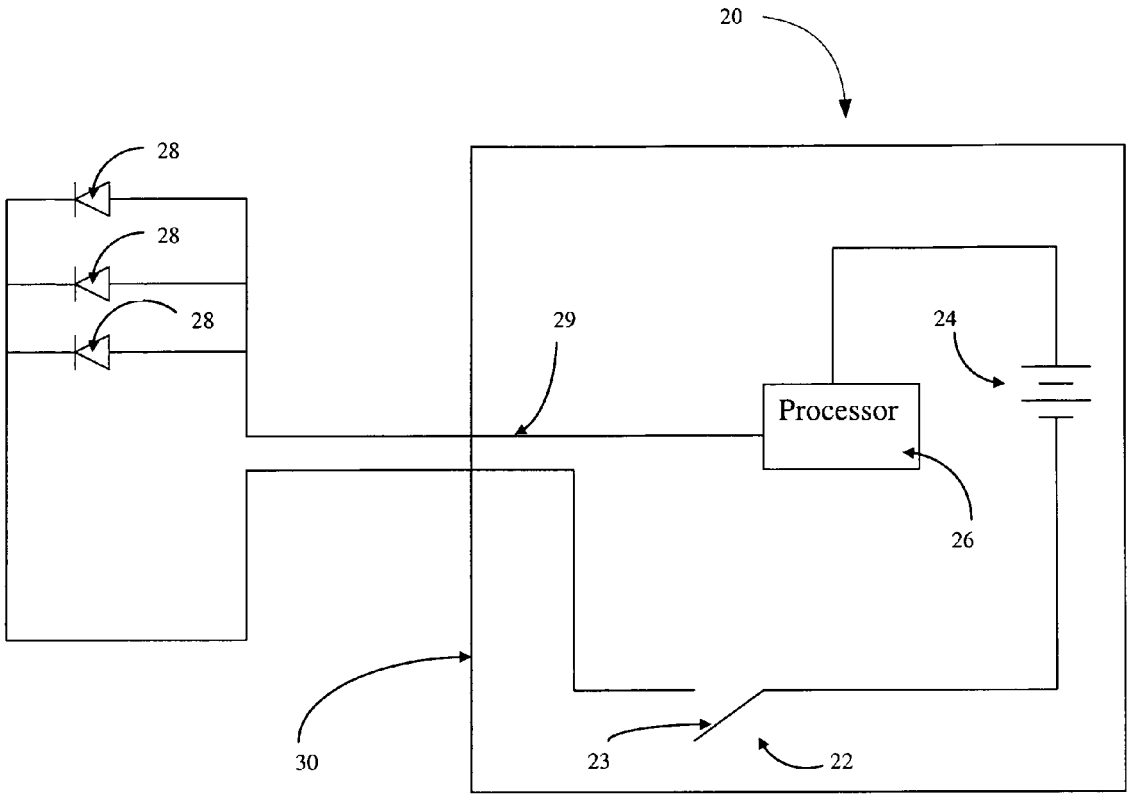
FIG. 22 illustrates the configuration of the controller.

While known controllers used in other technologies have been identified earlier, FIG. 22 illustrates a preferred embodiment of a controller 20 in accordance with aspects of the present invention. The controller 20 to the lights preferably includes a switch mechanism 20, and desirably has a battery or other power source 24 connected thereto. The switch mechanism 22 and the battery 24 are preferably enclosed within a casing 30, which is preferably plastic or some other durable housing material However, while FIG. 22 shows the battery/power source 24 as contained within the casing 30, is it possible for the battery 24 to be placed externally to the casing 30. For example, the battery 24 may be located in a separate location of the pogo stick from the casing 30 to allow easier access for replacing or recharging the battery 24. By way of example only, the battery 24 may be placed in the foot support plate 506 or the handle bar 504. The battery 24 may be of any shape or may be placed into a housing of any shape. Preferably, the battery 24 and/or its housing are shaped to fit into the pogo stick. For instance, the battery 14 or its housing may be generally round in cross-section so as to fit within a cylindrical tube of the handlebar or of the housing unit 102. The controller 20 is preferably coupled to the various lights 28 displayed on the pogo stick. The switch 22 enclosed within the casing 30 may include a resilient electrically conductive element 23 and an electrically conductive stationary contact 25. The resilient electrically conductive element 23 is desirably movable in the particular direction in response to actuation of the piston 508 impingement on the ground and/or in response to any motion of the pogo stick. At rest, the electrically conductive element 23 and stationary contact 25 do not touch and exhibit an open relationship. Actuation of the piston 508 on the ground or other movement of the pogo stick causes the resilient electrically conductive element 23 to come in contact with the stationary contact 25 in a closed relationship causing the lights 28 to turn on/off or function.

In a preferred embodiment, the controller 20 includes the switch 22, the battery 24, and a processor 26 enclosed in plastic casing 30. The processor 26 is not limited to any particular device or component, and may comprise, by way of example only, logic gates, electronic switches, etc. in a package such as an integrated circuit. The processor 26 is connected by wires 29 to an array of LEDs 28. For purposes of the present discussion, in response to movement of the switch 22 to a closed position, the processor 26 is electrically powered by the battery 24. When activated, the processor 26 operates to illuminate the LEDs 28 in a selected flashing or other sequence, and then to turn off the LEDs 28. The processor and other components of this embodiment may be used with any pogo stick and with any lighting configuration or arrangement as described in any of the embodiments herein. Processors capable of operating LEDs in a flashing sequence may include, for example, integrated circuits commercially available under part no. 6608 from Cheerine Development Ltd., a corporation of Hong Kong having a place of business at Room 1217, North Tower, Concordia Plaza, No. 1 Science Museum Road, Tsim Sha Tsui East, Kowloon, Hong Kong.

While described generally above, the switch 20 may operate as follows. In response to the impingement of the piston 508 on the ground or other force to the switch 22, the electrically conductive element 23 pivots in a pendulum-type motion so that it becomes engaged to the stationary contact 25. Upon engagement of the electrical conductive element 23 to the stationary contact 25, the battery 24 is connected to the processor 26 and the LEDs 28 are illuminated, as discussed above.

Once a lighting sequence has been completed, the processor 26 is effective to turn off the LEDs 28 and disconnect from the battery 24 even though the switch 22 may remain closed. This is preferably accomplished by the inclusion of a timing circuit in the processor 26 which disconnects the LEDs from the battery 24 after a predetermined period of time, regardless of the position of the switch 22, and then resets in preparation for another lighting sequence initiated by the switch 22. Timing circuits for this purpose are known in the art. See, for example, U.S. Pat. Nos. 4,848,009 and 6,280,045, the entire disclosures of which are hereby expressly incorporated by reference herein.

The processor 26 is an optional part to the controller 20. The processor 26 may be located within the housing 30 or can be placed in another location on the pogo stick. The processor 26, such as an integrated circuit, microprocessor, microcontroller, DSP, ASIC, etc., may be programmed to turn the lights on and off in different patterns and at different times when activated by the controller 20. For example, LED lights can be turned on and off via the processor 26 by switching all lights off at once. Additionally, lights can be turned on and off one after another in consecutive order, every other light, two or more lights at a time, by row, or any pattern or configuration desired. In a pogo stick having a rocket or astronaut theme, the lights may be configured to turn on and off sequentially, such as in a "launch" pattern.

Figure 23:
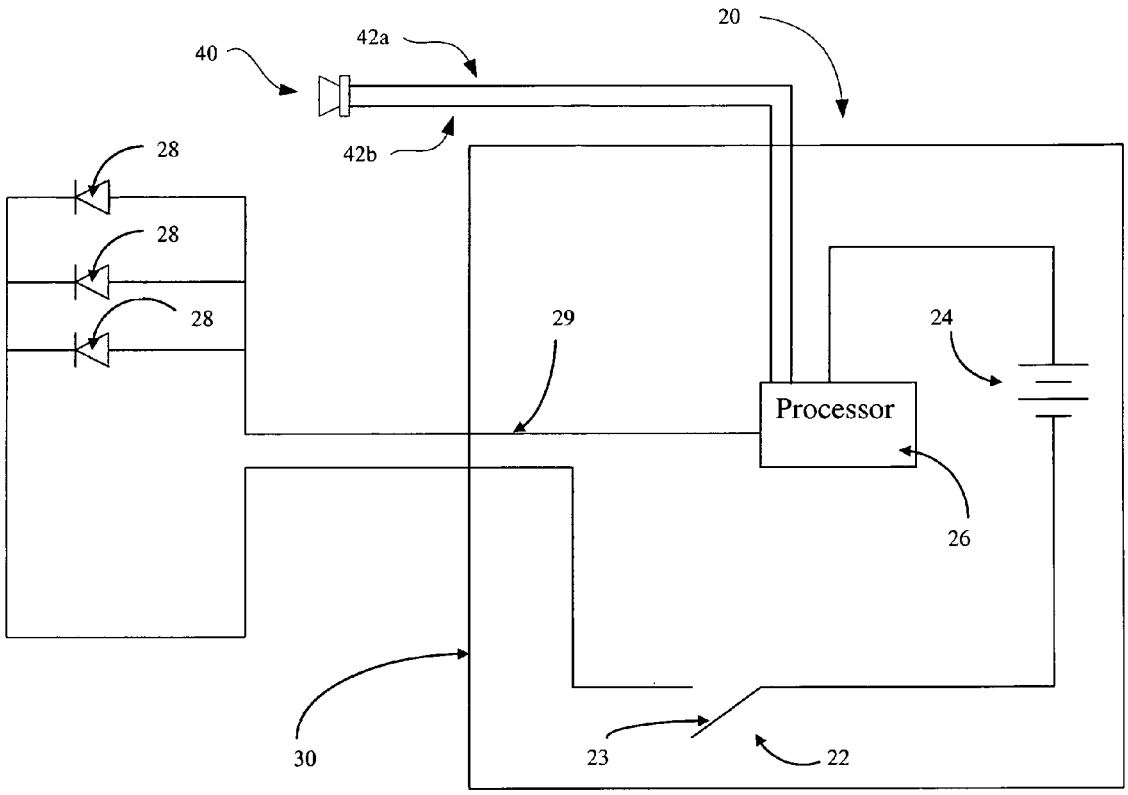
FIG. 23 illustrates an alternative configuration of a controller.

Of course, one or more sounds may accompany the lighting pattern, or may be used independently of any lighting pattern. FIG. 23 illustrates how a speaker or other transducer 40 may be configured along with the LEDs 28. Just as the lights may be programmed to operate in different patterns, sounds may also be programmed to work with the pogo stick or other device. The processor 26 may control sounds in addition to the lights. As seen in FIG. 23, the speaker 40 may have wiring 42*a,b* connecting it to the processor 26. By way of example only, the speaker 40 may be placed in the head of a themed pogo stick such as pogo stick 400. Alternatively, one or more speakers 40 may be placed along the housing 502 of pogo stick 500. The speaker(s) 40 may be embedded within or at least partly covered by the foam covering 511, as seen in the partial see through view of FIG. 18. Here, multiple speakers 40 may be used to enhance the visual effects of a launch pattern. For instance, the speakers 40 could sound on and off sequentially along with the lighting of the launch pattern.

The processor 26 may be further programmed to turn the LED lights on and off corresponding to how high the pogo stick user jumps. For example, if the pogo stick operator jumps high, the processor 26 may determine the amount of force applied and cause most or all of the lights to light up. However, if the operator jumps lower only one light may light up. If the operator jumps to a moderate height half the LED lights may light, by way of example only. Sound effects from the speaker(s) 40 may be used in this case as well.

LED lights on any of the aforementioned embodiments of the pogo stick may be placed on the pogo stick to serve several purposes and functions. The first of such purposes is for decoration and entertainment. Eyes of children and adults alike are drawn to flashing lights since they stand out among normal everyday objects. It is entertaining to watch lights flash on and off. Entertainment and decorative uses can be enhanced with different color lights placed in various arrays and configurations on any of the embodiments disclosed.

The processor 26 may also be programmed to illuminate lights to facilitate an exercise routine. Colored lights might act as a signal to the user to jump differently. One color light might indicate the user to jump side to side, while another color light can indicate the user to jump front and back, while yet another color light may indicate the user to jump high or low, slow or fast, for example. Sound effects may also enhance the exercise routine.

In similar fashion, lights can be programmed by the processor 26 to facilitate games and challenges for children. Lights can be programmed so that the higher a user jumps the more lights will light up, for example. The higher a user jumps can be related to how high successive lights will light up. Such lights can also correspond to color to indicate how high a user jumps. Additionally, the more jumps a user has before falling off the pogo stick may facilitate new colors of lights lighting up. For example, if the pogo stick operator has between 0 and 10 jumps one color light may light. If the operator has between 11 and 20 jumps another color may light up. In more challenging pogo jumping, the lights on the housing may indicate to observers the type of trick being performed, the level of difficulty, the operator's name or nickname, etc. The processor 26 may be programmed to provide complementary sound effects in this case as well.

Lights on the pogo stick that turn on and off with the aforementioned controller 20 and/or processor 26 may enable a user to operate the pogo stick at night and in dimly lighted areas. This allows a user to expand upon the time a pogo stick can be used. Instead of being limited to only jumping under daylight, a pogo stick user can now enjoy using a pogo stick at night time.

Lights can be programmed by the processor 26 so that some lights are on during the use/upward motion of the pogo stick. Those lights can be programmed to turn off and a different set of lights can turn on during the downward/resting motion of the pogo stick. Lights turning on and off in this manner can be programmed to do so in any color configuration and on/off pattern.

The lights may also be part of a display, such as an LED or LCD display. Depending upon the size and resolution of the display, it may be programmed or configured to display messages to onlookers when someone is riding the pogo stick. By way of example only, in the embodiment of FIGS. 6-10, the display may be positioned along one or more walls of the shell 214. The display may be programmed to spell out the rider's name, present a slogan or pictures, or may even illustrate different tricks that can be performed on the pogo stick.

Figure 24A:
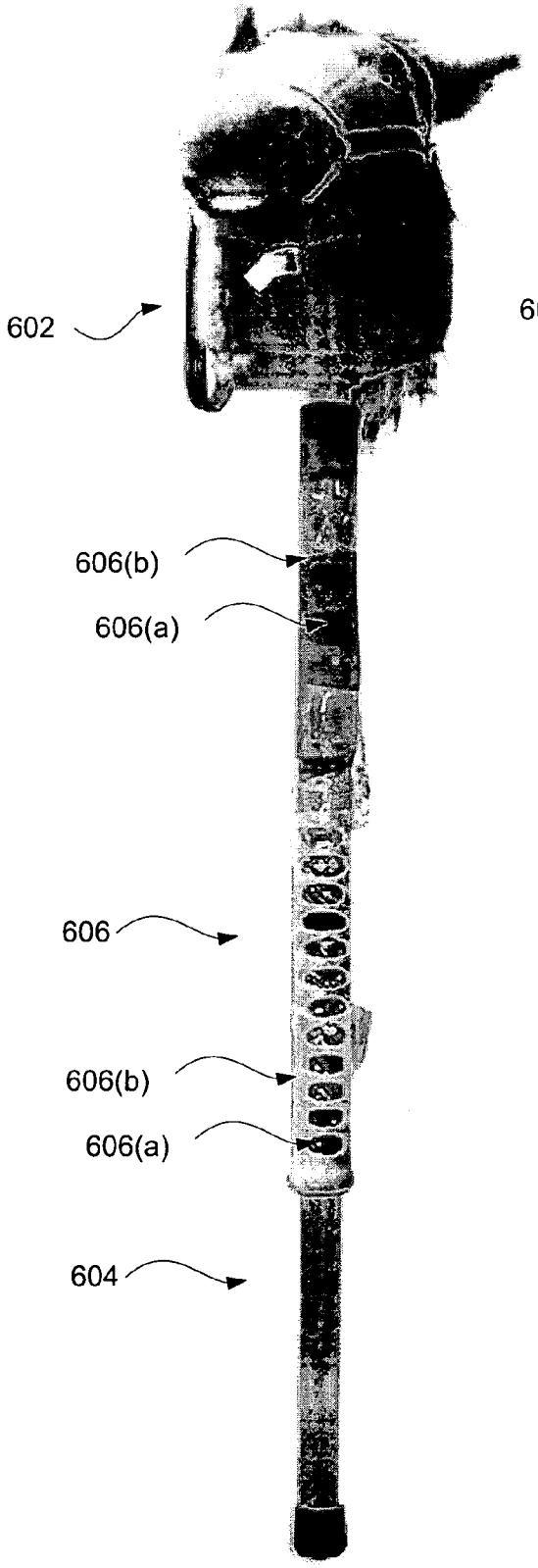
FIG. 24 illustrates a light up stick horse in accordance with an aspect of the present invention.
Figure 24B:
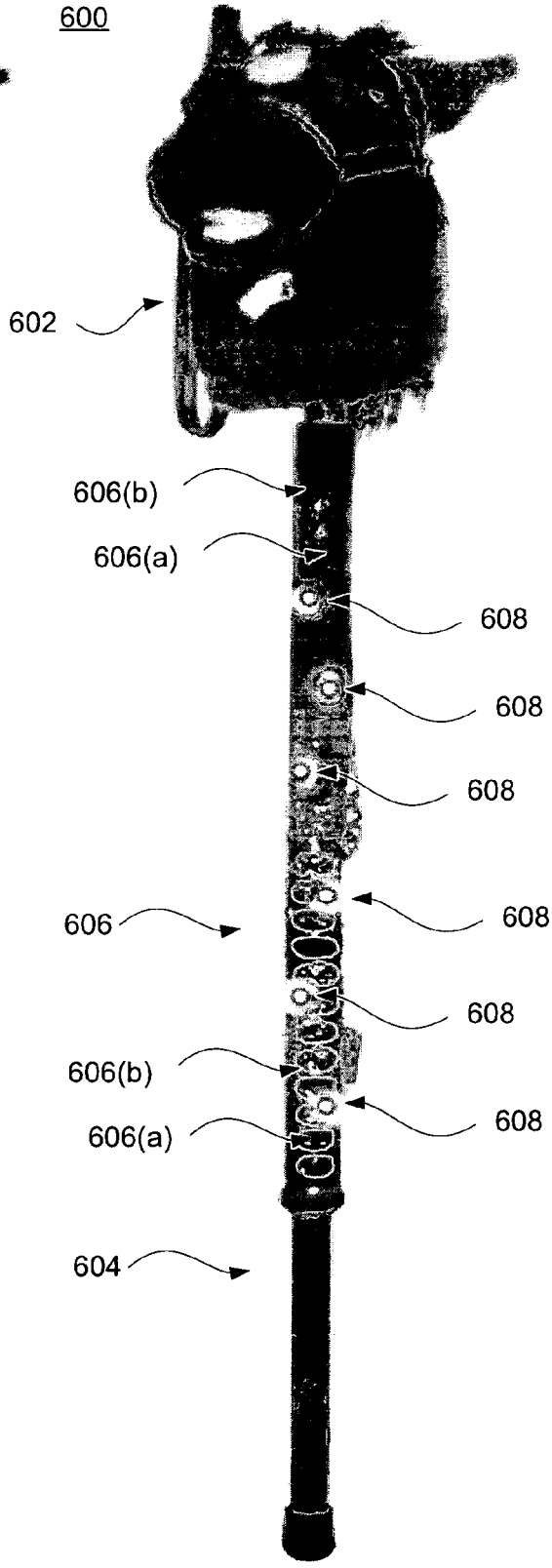

The lights and foam coverings described above are not limited merely to pogo sticks. For example, as shown in FIGS. 24(*a*) and 24(*b*), they may also be used in stick horses to provide enhanced entertainment. FIG. 24(*a*) illustrates a stick horse 600 with a plush horse's head 602 connected to a shaft 604. The shaft 604 may be of wood, metal, plastic or other material(s). As shown, the shaft 604 may be at least partly covered in a foam liner 606. As discussed above with respect to foam covering 511, the foam liner 606 may be a single piece or may comprise multiple sections and/or layers. Each section and/or layer may have different colors, patterns, designs, textures, thickness or configurations. All of the various possibilities and options for the foam covering 511 discussed above may be used with the foam liner 606.

Preferably, the foam liner 606 comprises an inner foam layer 606(*a*) which is covered by an outer foam layer 606(*b*). The outer foam layer 606(*b*) is preferably scalloped to reveal portions of the inner foam layer 606(*a*). As above, lights 608 may be protected and partly covered by the foam liner 606. As shown in FIG. 24(*b*), the lights 608 may be positioned along the scalloped portions of foam liner 606, although they may be positioned anywhere along the foam liner 606 covering the shaft 604. Alternatively, one or more lights 608 may be disposed along the shaft 604 and not protected by the foam liner 606. The wiring for the lights 608 is not shown. However, it should be understood that the lights are electrically connected to a battery, and optionally to processor 26. The lights 608 may operate in any of the manners described above.

Although the invention herein has been described with reference to particular embodiments, it is to be understood that these embodiments are merely illustrative of the principles and applications of the present invention. For example, the patterns and colors of lights arranged on the housing unit are not limited to those described herein. Such arrangements described in any embodiment may be employed in any other embodiment in accordance with the invention. The themed pogo is not limited to the pogo pony or pogo unicorn, and may be employed in any type of themed pogo stick. LED or other lights may not only be placed on the housing unit but on other locations of the pogo stick. Additionally, housing units and members are not limited to the shapes or styles herein described, and may encompass any configurations employed with pogo-type devices. For example the housing unit or support members can be cylindrical, rectangular, hexagonal, or octagonal in shape. It is therefore to be understood that numerous modifications may be made to the illustrative embodiments and that other arrangements may be devised without departing from the spirit and scope of the present invention as defined by the appended claims.

What is claimed is:

1. A pogo stick apparatus, comprising:

a housing unit including a spring mechanism and having first and second ends;

a foot support member attached to the first end of the housing unit;

a piston coupled to the spring mechanism, the piston being operable to extend and retract relative to the first end of the housing unit;

a foam covering at least partly enclosing an exterior surface of the housing unit; and a plurality of lights distributed along the length of said housing unit between the first and second ends thereof and at least partly protected by the foam covering, the plurality of lights being operable to turn on and off during use of the pogo stick apparatus.

2. The pogo stick apparatus of claim 1, further comprising a handlebar attached to the second end of the housing unit, wherein the foam covering at least partly covers the handlebar.

3. The pogo stick apparatus of claim 1, wherein the lights are motion activated.

4. The pogo stick apparatus of claim 1, wherein the foam covering comprises a plurality of layers.

5. The pogo stick apparatus of claim 4, wherein a first one of the layers at least partly encloses the exterior surface of the housing unit, and a second one of the layers at least partly covers the first layer.

6. The pogo stick apparatus of claim 5, further comprising wiring electrically connecting the plurality of lights to a power supply, the wiring being at least partly disposed between the first and second layers of the foam covering.

7. The pogo stick apparatus of claim 5, wherein the second layer of the foam covering has a scalloped pattern revealing portions of the first layer of the foam covering.

8. The pogo stick apparatus of claim 7, wherein at least one of the lights is protected by the first layer of foam covering and is revealed by the scalloped pattern.

9. The pogo stick apparatus of claim 1, further comprising control means coupled to the plurality of lights for managing operation of the plurality of lights.

10. The pogo stick apparatus of claim 9, further comprising a speaker for producing sounds during use of the pogo stick apparatus, the speaker being coupled to the control means.

11. The pogo stick apparatus of claim 9, wherein the speaker is at least partly protected by the foam covering.

12. A pogo apparatus, comprising:

a housing including spring means, a first end, and a second end remote from the first end;

means for supporting a user's feet, the support means being coupled to the first end of the housing;

a piston coupled to the spring means, the piston being operable to extend and retract relative to the first end of the housing;

a covering at least partly covering the housing between the first and second ends thereof;

lighting means disposed along the housing between the first and second ends thereof, the lighting means being at least partly protected by the covering and being operable to turn on and off during use of the pogo stick apparatus; and means for electrically coupling the lighting means to a power source, the means for electrically coupling the lighting means being at least partly protected by the covering.

13. The pogo apparatus of claim 12, wherein the covering comprises a plurality of foam layers.

14. The pogo apparatus of claim 13, wherein a first one of the foam layers covers at least part of the housing and a second one of the foam layers reveals portions of the first foam layer.

15. The pogo apparatus of claim 12, further comprising control means coupled to the lighting means for managing operation of the lighting means.

* * * * *